US007658608B2

(12) United States Patent
Weathersbee

(10) Patent No.: US 7,658,608 B2
(45) Date of Patent: Feb. 9, 2010

(54) METHOD OF FORMING A CANDLE WITH IMBEDDED IMAGES

(76) Inventor: Nicolas A. Weathersbee, 620 45th Ave. North, St. Petersburg, FL (US) 33703

( * ) Notice: Subject to any disclaimer, the term of this patent is extended or adjusted under 35 U.S.C. 154(b) by 0 days.

(21) Appl. No.: 12/237,465

(22) Filed: Sep. 25, 2008

(65) Prior Publication Data

US 2009/0081600 A1 Mar. 26, 2009

Related U.S. Application Data

(60) Provisional application No. 60/975,280, filed on Sep. 26, 2007.

(51) Int. Cl.
*F23D 3/02* (2006.01)

(52) U.S. Cl. ..... 431/289; 431/126; 431/288; 431/325; 264/3.5; 264/3.6; 264/139; 362/157; 362/159; 362/161

(58) Field of Classification Search ..... 431/126, 431/288, 289, 325; 326/157, 159, 161; 264/3.5, 264/3.6, 139
See application file for complete search history.

(56) References Cited

U.S. PATENT DOCUMENTS 2,817,225 A 12/1957 Weglin
2,841,972 A 7/1958 Weglin
3,286,492 A * 11/1966 Frazier, Jr. ..... 40/541
3,901,990 A * 8/1975 Solomon ..... 428/400
4,017,729 A * 4/1977 Frazier, Jr. ..... 362/161
4,096,299 A 6/1978 Stewart
4,588,618 A * 5/1986 Wolfe ..... 428/7
5,395,233 A * 3/1995 Karp ..... 431/289
5,833,906 A * 11/1998 Widmer ..... 264/245
6,153,137 A 11/2000 Youn et al.
6,406,290 B1 6/2002 Chon
6,450,802 B1 9/2002 Steck
6,474,980 B2 11/2002 LaVanier
6,554,448 B2 * 4/2003 Carpenter et al. ..... 362/161
6,660,207 B1 * 12/2003 Youn ..... 264/259
6,918,681 B2 * 7/2005 Brizzie ..... 362/161

(Continued)

OTHER PUBLICATIONS

Authors Virginia Tucker & Linda Rocamontes, Embellished Candles Without Hot Wax, 1995, Pub. Suzanne McNeill, #4005, pp. 7 & 14.*

(Continued)

*Primary Examiner*—Steven B McAllister
*Assistant Examiner*—Daniel E Namay
(74) *Attorney, Agent, or Firm*—Larson & Larson, P.A.; Frank Liebenow

(57) ABSTRACT

An application for a method of making a candle includes providing a candle core and adding a base layer of wax to the candle core. Next, an image area is cut out of the base layer large enough to contain an image and the base layer is peeled away from the candle core in the image area. An adhesion layer of wax is added to the candle core. An image is installed in the image area. A clear layer of wax is added to the candle core, also covering the image. An outer layer of wax is added to the candle core, also covering the image area then the image area is cut out of the outer layer and the outer layer is peeled away from the candle core in the image area.

19 Claims, 4 Drawing Sheets

U.S. PATENT DOCUMENTS

| | | | | |
|---|---|---|---|---|
| 7,004,752 | B2 * | 2/2006 | Weathersbee | 431/288 |
| 7,144,246 | B2 * | 12/2006 | Barnstead | 431/126 |
| 2001/0029696 | A1 * | 10/2001 | DeStefano et al. | 44/275 |
| 2001/0043469 | A1 * | 11/2001 | Carpenter et al. | 362/161 |
| 2002/0102507 | A1 * | 8/2002 | Riches | 431/289 |
| 2003/0104330 | A1 * | 6/2003 | Joyner | 431/288 |
| 2004/0197722 | A1 * | 10/2004 | Hudnall | 431/289 |
| 2006/0172241 | A1 * | 8/2006 | Hohertz | 431/289 |
| 2008/0094825 | A1 * | 4/2008 | Silver | 362/161 |

OTHER PUBLICATIONS

Author Darl Lawon, Candles By Design, 2001, Grace Publications LLC, pp. 2, 10, 11, Back Cover.*

* cited by examiner

METHOD OF FORMING A CANDLE WITH IMBEDDED IMAGES

PRIOR APPLICATIONS

This application is a non-provisional of co-pending provisional patent application Ser. No. 60/975,280, filed Sep. 26, 2007.

FIELD OF THE INVENTION

This invention relates to the field of manufacturing candles and, more particularly, to a method of manufacturing candles with one of more imbedded images.

BACKGROUND OF THE INVENTION

Paraffin waxes have been used to make candles for hundreds of years. Early candles were made by dipping a wick in molten paraffin ladled into molds. Upon cooling, the candle was ready for use. Additives were added to molten paraffin to color the wax, but many of the early additives interfered with the burning of the candle or caused toxic fumes, contaminating the air in which the candles burned. Subsequently, pigments of either mineral or organic origin were developed which did not interfere with candle burning or contaminate the air around the burning candle. With such discovery, it was not long before candle makers started decorating candles such as shown in U.S. Pat. Nos. 2,817,225; 2,841,972; 4,096,299; and 6,450,802. Many different colors in a single candle provide more decorative patterns and is highly desirable. Dipping candles into a colored wax, then directly into another colored wax, and blowing on the surface of the candle as it comes out of the colored wax has been a traditional way of making decorative patterns on candles. However, this procedure causes the wax to blend and separate giving a marble like effect. This procedure contaminates one color with another, losing the original color in time and the color becomes muddied. Current techniques cannot produce candles that are free from the bleeding of one color layer into another. In addition, attempts have been made in the prior art to add pigmented waxes of one color over a pigmented wax of another color. However, this has previously proved unsatisfactory in that the outer pigmented layer sticks to the lower pigmented layer and therefore, cannot be cleanly peeled off.

A solution to these problems is presented in U.S. Pat. No. 7,004,752 to Weathersbee. This patent teaches a method of forming a candle with multiple peelable layers of wax. This patent does not show how an image would be inserted into a candle using these peelable layers.

What is needed is a method of forming a candle containing one or more images using peelable layers.

SUMMARY OF THE INVENTION

In one embodiment, a method of making a candle is disclosed including providing a candle core and adding a base layer of wax to the candle core. Next, an image area is cut out of the base layer large enough to contain an image and the base layer is peeled away from the candle core in the image area. An adhesion layer of wax is added to the candle core, and then an image (e.g., a printed image or a photograph) is installed onto the adhesion layer in the image area. A clear layer of wax is added to the candle core, also covering the image. An outer layer of wax is added to the candle core, also covering the image area then the image area is cut out of the outer layer and the outer layer is peeled away from the candle core in the image area.

In another embodiment, a candle with an embedded image is disclosed including a candle core. A base layer of wax covers the candle core in all areas except for an area where the image will go. An adhesion layer of wax covers the entire candle core including the area where the image (e.g., a printed image or a photograph) will go and the image is atop the adhesion layer of wax in the area where the image will go. A clear layer of wax covers the base layer of wax and the area over the image and an outer layer of wax covers the base layer of wax.

In another embodiment, a method of making a candle is disclosed including providing a candle core and adding a base layer of wax to the candle core. Next, an image area is cut out of the base layer large enough to contain an image and the base layer is peeled away from the candle core in the image area. Next an adhesion layer of wax is added to the candle core and the image area and an image (e.g., a printed image or a photograph) is installed in the image area and any air pockets are removed from beneath the image by rubbing. A clear layer of wax is added to the candle core, also covering the image and the clear layer of wax is rubbed only in the image area. An outer layer of wax is added to the candle core, also covering the image area then the image area is cut out of the outer layer and the outer layer is peeled away from the candle core in the image area.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1:
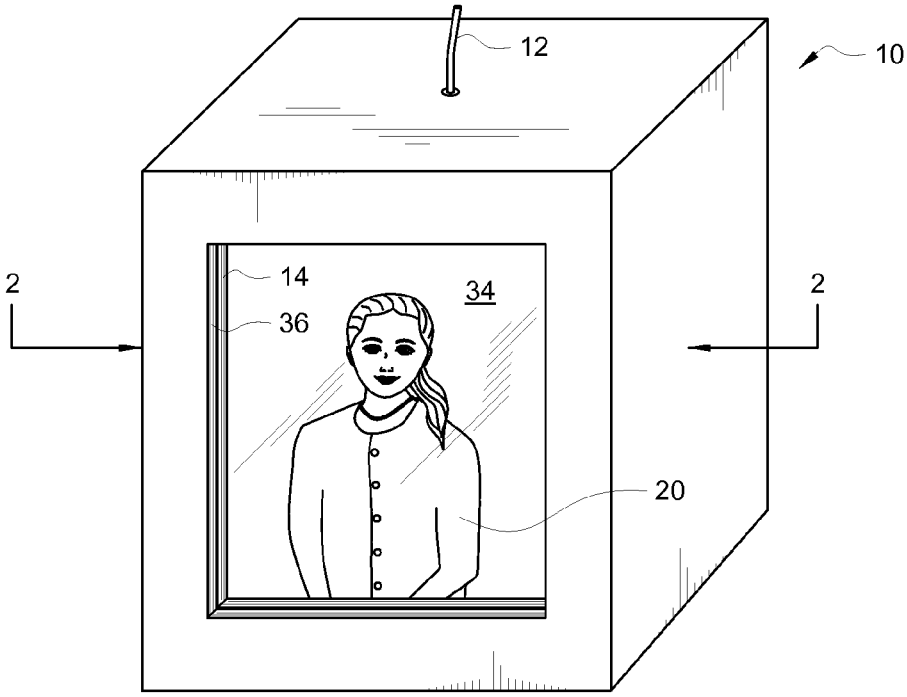
FIG. 1 illustrates a completed candle of the present invention.

Reference will now be made in detail to the presently preferred embodiments of the invention, examples of which are illustrated in the accompanying drawings. Throughout the following detailed description, the same reference numerals refer to the same elements in all figures. Although a method for assisting in the ability to peel off layers of wax used in the present invention is described in U.S. Pat. No. 7,004,752 to Wheathersbee, any known method of enabling such a peeling operation is anticipated and in some embodiments, substituted for the methods of U.S. Pat. No. 7,004,752. U.S. Pat. No. 7,004,752 to Wheathersbee is hereby included by reference.

Referring to FIG. 1, a finished candle of the present invention will be described. The candle 10 has a wick 12 for burning. An image from a photographic or printed image 20 is framed by an edge 14/36. Areas of the candle beyond the image 20 are coated with layers of wax of any color or clear, the outer layers 36 are visible.

Figure 2:
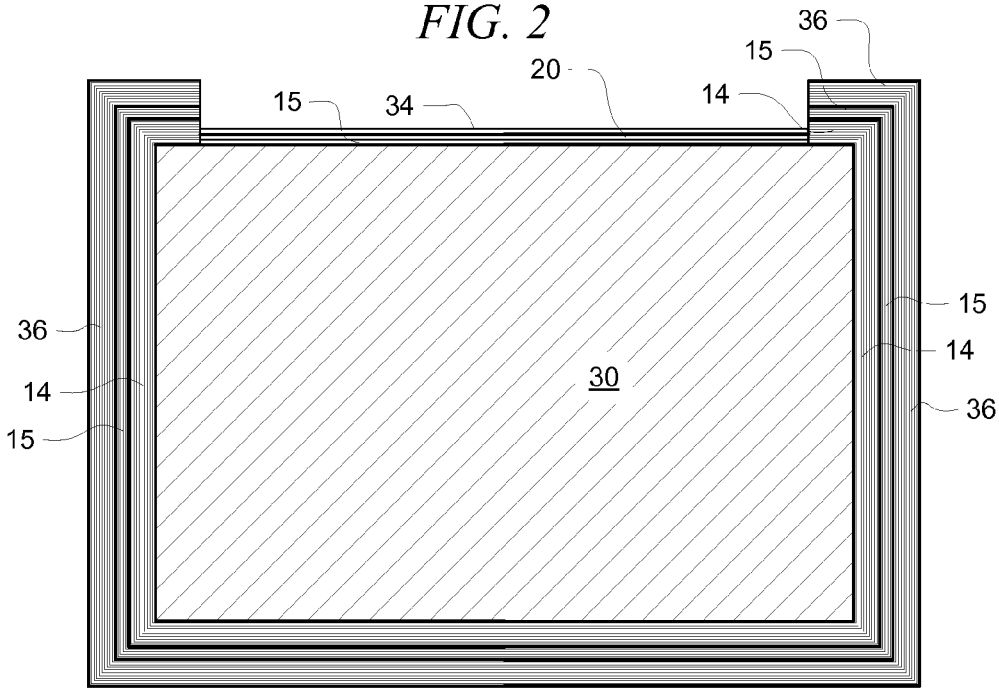
FIG. 2 illustrates a cross-sectional view along lines 2-2 of the candle of FIG. 1.

Referring to FIG. 2, a cross-sectional view along lines 2-2 of the finished candle of FIG. 1 is shown. In the area of the image 20, the layers above the core 30 include an adhesion layer of wax 15, the image 20 and one or more covering layers of clear wax 34, permitting the image to be visible. In some embodiments, for artistic reasons, this covering layer 34 consists of one or more layers of any color wax and in such embodiments; the image 20 is visible while the candle 10 is burning, through the covering layers 34. The rest of the surface of the core 30 is covered by the base layer of wax 34, the adhesion layer of wax 15 and an outer layer of wax 36. The method of making this candle is described in steps starting with FIG. 3 through FIG. 9.

Figure 3:
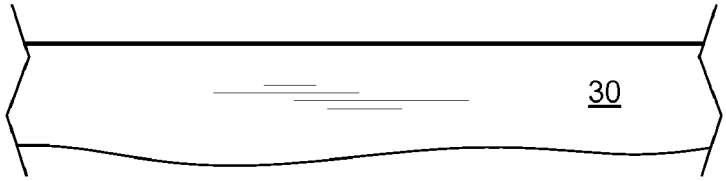
FIG. 3 illustrates a cut-away edge of a candle core before adding layers of the present invention.

Referring to FIG. 3, a cut-away edge of a candle core before adding layers of the present invention is shown. The core 30 of the candle is known in the industry. The core 30 is of any shape that has a planar surface for accepting a planar image 20. For example, some cores 30 are cylindrical cores, polygon cores, cubic cores, polytope cores, dodecahedron cores, polyhedra cores, etc. It is desirable to have at least one planar surface onto which the image 20 is affixed. In some embodiments, cores without a planar surface, such as spherical cores, are used. In such embodiments, a planar (flat) surface large enough to fit the planar image 20 is made in the core by cutting, sanding or other methods.

Figure 4:
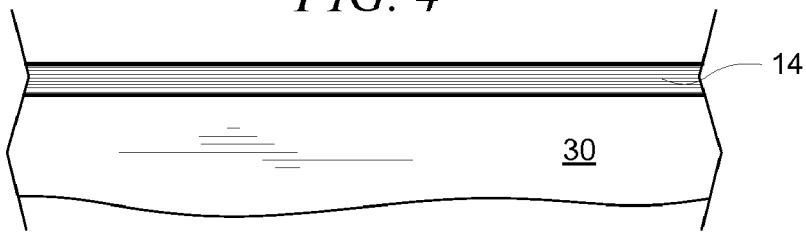
FIG. 4 illustrates the cut-away edge of the candle core after adding a set of base layers.

Referring to FIG. 4, the cut-away edge of the candle core after adding a set of base layers will is shown. The core 30 is dipped in molten wax as many times as desired, usually from 2 to 50 times, preferably 10 times. In a preferred embodiment, the core is alternately dipped in molten wax then in water to solidify the wax. Although any color wax is used in this step, it is preferred that the wax be clear. The result is a base layer 14 of the desired thickness.

Figure 5:
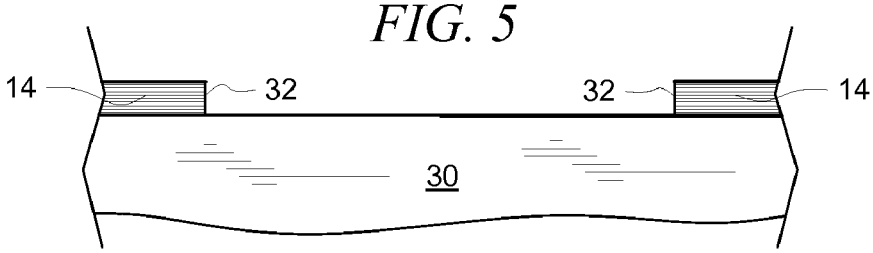
FIG. 5 illustrates the cut-away edge of the candle core after cutting and peeling a section of the base layers where the picture will reside.

Referring to FIG. 5, the cut-away edge of the candle core after cutting and peeling a section of the base layers where the picture will reside is shown. An area of the base layer 14 is cut to accommodate the picture/image 20 (see FIG. 6), preferably with a blade such as a razor or exacto-knife. In some embodiments, a template of any suitable material is made to match the shape of the image and is used to guide in cutting through the base layers 14 at cut points 32. Once the incision is made completely around the area where the image 20 will be placed, the base layers 14 are peeled away from the core in the area where the image 20 will be placed.

Figure 5A:
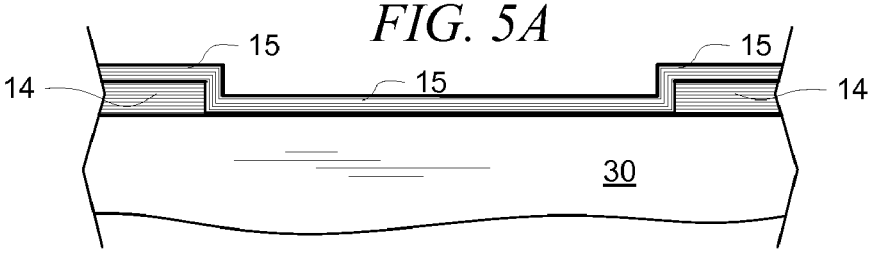
FIG. 5A illustrates the cut-away edge of the candle core after adding a layer of wax on which the picture will reside.

Referring to FIG. 5A, the cut-away edge of the candle core after adding a layer of wax on which the picture will reside is shown. To provide a surface on which the image 20 will adhere, the candle core 30 is dipped into molten wax as many times as needed to achieve the desired thickness of the adhesion layer 15. In the preferred embodiment, the candle core 30 is alternately dipped in water after each dip in the molten wax to solidify the adhesion layer 15. Although any number of dipping cycles is anticipated, from one to 50 dipping cycles is preferred and more preferably 5 dipping cycles.

Figure 6:
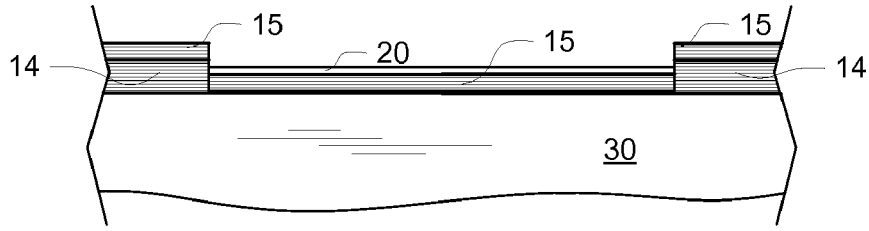
FIG. 6 illustrates the cut-away edge of the candle core after placing the picture in the cut area.

Referring to FIG. 6, the cut-away edge of the candle core after placing the picture in the cut area is shown. The picture 20 or image is placed on the adhesion layer 15 in a section within the cuts 32. It is preferred to rub the image 20 from the center of the image 20 outward using a finger, roller, squeegee or other implement to remove all air pockets before proceeding to the next step.

Figure 7:
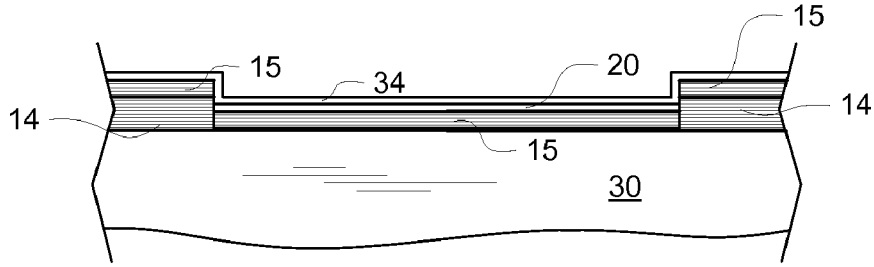
FIG. 7 illustrates the cut-away edge of the candle core after adding a layer of clear wax.

Referring to FIG. 7, the cut-away edge of the candle core after adding a layer of wax (preferably clear wax) is shown. After the image 20 is in place on the adhesion layer 15, the core 30 containing the image 20 is dipped into molten wax (preferably clear) and hung to cool (solidify), creating a clear wax layer 34. It is preferred to not dip the work product into water as in the previous steps. The work product should cool (solidify) in 30 seconds to 2 hours (5 minutes is preferred).

Figure 8:
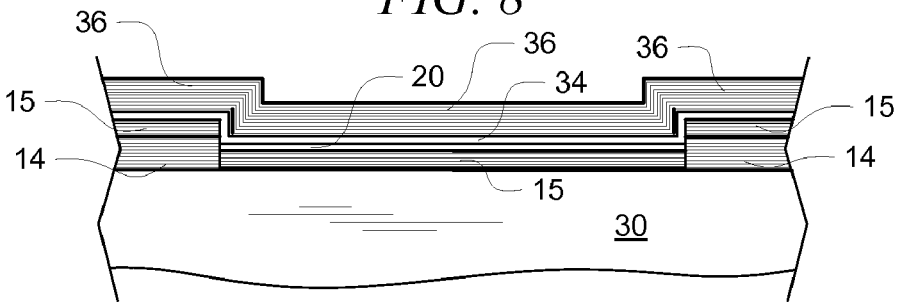
FIG. 8 illustrates the cut-away edge of the candle core after adding a set of outer layers.

Referring to FIG. 8, the cut-away edge of the candle core after adding a set of outer layers is shown. Before adding the outer layers 34, the entire wax coating 34 above the image is rubbed with a human thumb, finger, hand, or equivalent implement then the work product is coated with wax by dipping it into molten wax, then water, repeatedly until the desired thickness is achieved, creating an outer layer 36. In some embodiments, the work product is dipped in molten wax, then water, repeatedly from 2 to 50 times, preferably 10 times. Preferably, clear wax is used in this step.

Figure 9:
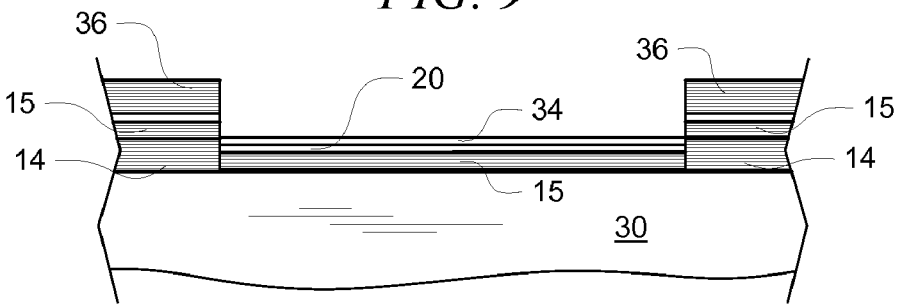
FIG. 9 illustrates t the cut-away edge of the candle core after cutting and peeling the set of outer layers from over the picture.

Referring to FIG. 9, the cut-away edge of the candle core after cutting and peeling the set of outer layers from over the picture is shown. After the last outer layer 36 is added, the outer layer 36 is cut around the edge 35 of the image 20 and the outer layer 36 is peeled off of the coating of clear wax 34 over the image.

Figure 10:
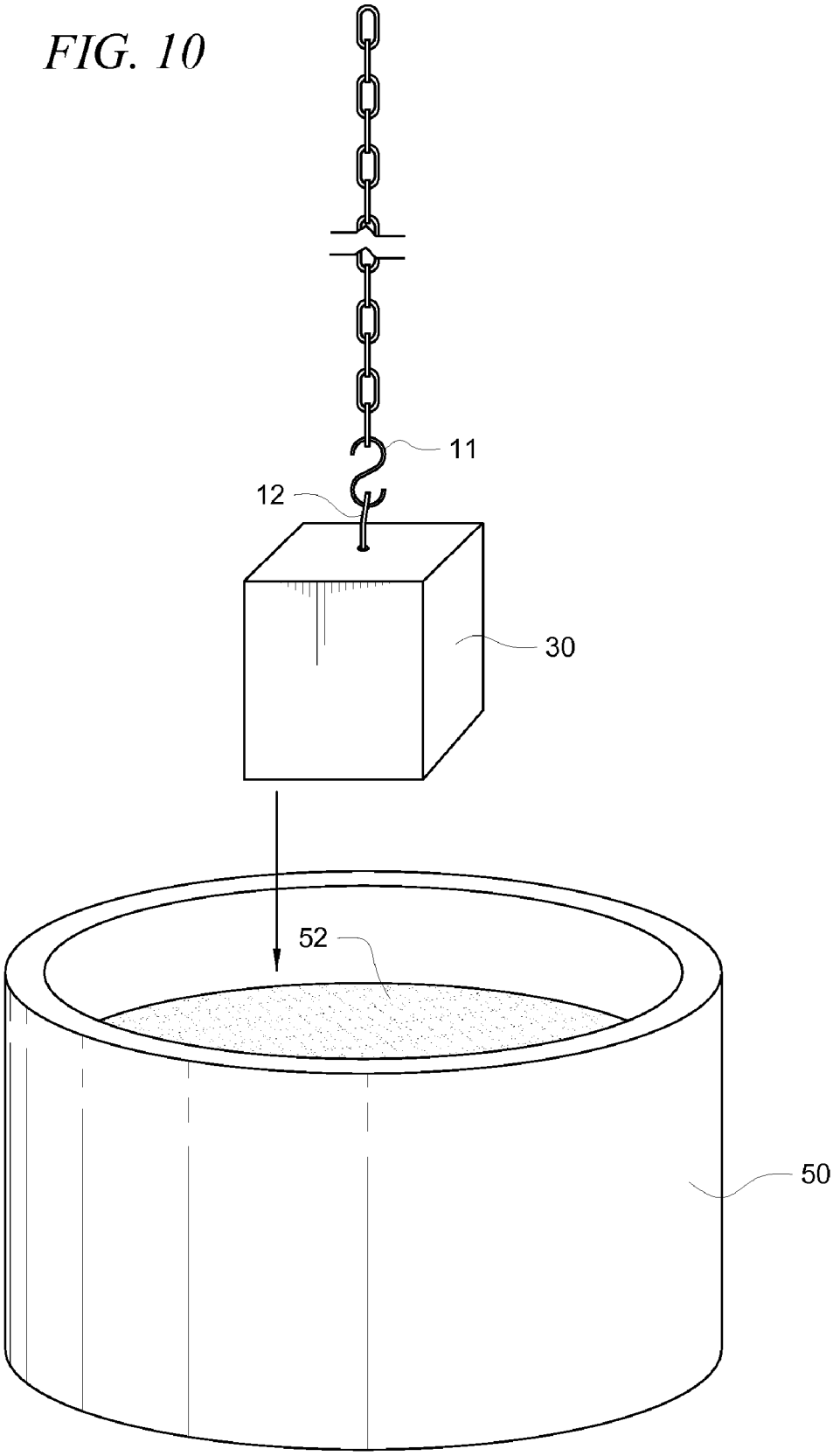
FIG. 10 illustrates a method of forming wax layers on the candle core.

Referring to FIG. 10, the method of forming wax layers on the candle core will be described. The core 30 (or work product) is held by its wick 12, preferably by a hook 11 and dipped into a vat 50 of molten wax 52. In some steps of the preferred embodiments, the core 30 (or work product) is alternately dipped in vats of water (not shown) to solidify the molten wax. In some steps of the present invention, the core 30 (or work product) is hung by the wick 12 and/or hook 11 to solidify without the use of water.

Equivalent elements can be substituted for the ones set forth above such that they perform in substantially the same manner in substantially the same way for achieving substantially the same result.

It is believed that the system and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A method of making a candle, the method comprising:

providing a candle core;

adding a base layer of wax to the candle core;

cutting around an image area in the base layer, the image area sized to contain an image;

peeling the base layer away from the candle core in the image area;

adding an adhesion layer of wax over the base layer and over the image area;

installing the image onto the adhesion layer in the image area;

adding a cover layer of wax over the adhesion layer and over the image, the cover layer of wax covering the image;

adding an outer layer of wax over the cover layer and over the image, the outer layer of wax covering the image;

cutting the outer layer around the image area; and peeling the outer layer off of the image area.

2. The method of claim 1, wherein the step of adding the base layer of wax includes repeating the steps of:

dipping the candle core in molten wax; and dipping the candle core in water;

until a desired number of base layer coats is achieved.

3. The method of claim 1, wherein the step of adding the outer layer of wax includes repeating the steps of:

dipping the candle core in molten wax; and dipping the candle core in water;

until a desired number of outer layer coats is achieved.

4. The method of claim 1, wherein the step of adding the cover layer of wax includes the steps of:

dipping the candle core into molten wax; and waiting to allow the molten wax to solidify.

5. The method of claim 4, wherein the molten wax is clear wax.

6. The method of claim 2, wherein the desired number of base layer coats is from 2 to 50.

7. The method of claim 3, wherein the desired number of outer layer coats is from 2 to 50.

8. The method of claim 1, wherein the step of installing the image further includes the step of rubbing the image to remove air pockets from beneath the image.

9. The method of claim 1, further comprising after the step of adding the cover layer of wax, a step of rubbing the cover layer of wax over the image area.

10. The method of claim 9, wherein the step of rubbing is performed by rubbing with a finger.

11. The method of claim 1, wherein the step of adding the adhesion layer of wax includes repeating the steps of:

dipping the candle core in molten wax; and dipping the candle core in water;

until a desired number of adhesion layer coats is achieved.

12. The method of claim 1, wherein the image is selected from the group consisting of a photograph and a printed image.

13. A method of making a candle, the method comprising:

providing a candle core;

adding a base layer of wax to the candle core;

cutting around an image area in the base layer of wax, the image area sized to contain an image;

peeling the base layer within the image area away from the candle core;

adding an adhesion layer of wax over the base layer and the image area;

installing the image in the image area on top of the adhesion layer;

rubbing the image to remove air pockets from beneath the image;

adding a cover layer of wax over the adhesion layer and over the image, the cover layer of wax covering the image;

rubbing the cover layer of wax over the image;

adding an outer layer of wax over the cover layer, the outer layer of wax covering at least the image area;

cutting through the outer layer of wax around the image; and peeling the outer layer away from the image.

14. The method of making a candle according to claim 13, wherein the image is selected from the group consisting of a photograph and a printed image.

15. The method of making a candle according to claim 13, wherein the step of adding the base layer of wax includes repeating the steps of:

dipping the candle core in molten wax; and dipping the candle core in water;

until a desired number of base layer coats is achieved.

16. A candle with an embedded image, the candle comprising:

a candle core;

a base layer of wax covering the candle core in all areas except for an area for an image;

an adhesion layer of wax covering the base layer and the area for the image;

an image affixed to the adhesion layer in the area for an image;

a cover layer of wax covering the adhesion layer of wax and covering the image; and an outer layer of wax covering the cover layer of wax, except for the image area.

17. The candle with an embedded image of claim 16, wherein the cover layer of wax is clear wax.

18. The candle with an embedded image of claim 16, wherein the base layer consists of from 2 to 50 layers of wax.

19. The candle with an embedded image of claim 16, wherein the outer layer consists of from 2 to 50 layers of wax.

* * * * *